United States Patent [19]

Eysn et al.

[11] 4,128,233

[45] Dec. 5, 1978

[54] CONVERTER-BOTTOM-FASTENING MECHANISM

[75] Inventors: Manfred Eysn, Linz; Hans Moser, Seewalchen, both of Austria

[73] Assignee: Vereinigte Österreichische Eisen- und Stahlwerke — Alpine Montan Aktiengesellschaft, Linz, Austria

[21] Appl. No.: 829,715

[22] Filed: Sep. 1, 1977

[30] Foreign Application Priority Data

Oct. 21, 1976 [AT] Austria ..... 7829/76

[51] Int. Cl.[2] ..... C21C 5/46

[52] U.S. Cl. ..... 266/243; 220/324; 220/325; 220/327; 292/256.6

[58] Field of Search ..... 266/218, 220–224, 266/243–247; 90/DIG. 14; 269/92, 94; 292/256.6, 258; 220/324, 325, 327, 328; 339/266 R, 266 F

[56] References Cited

U.S. PATENT DOCUMENTS

| | | | |
|---|---|---|---|
| 162,866 | 5/1875 | Squire | 269/94 |
| 2,639,744 | 5/1953 | Herbert | 269/92 |
| 2,872,854 | 2/1959 | Chow | 269/94 |
| 3,578,306 | 4/1971 | Smith | 269/94 |
| 3,712,606 | 1/1973 | Cole | 269/92 |
| 3,851,865 | 12/1974 | Fisher | 266/224 |
| 4,022,445 | 5/1977 | Langenfeld et al. | 266/224 |

*Primary Examiner*—Gerald A. Dost

*Attorney, Agent, or Firm*—Brumbaugh, Graves, Donohue & Raymond

[57] ABSTRACT

A converter bottom-fastening mechanism to be used in a converter construction with a removable converter bottom, a converter jacket and a supporting construction connected to the converter jacket. The bottom-fastening mechanism includes a plurality of rocker-like clamping levers peripherally arranged about the converter bottom and fastened to the converter jacket or to the supporting construction. The levers are axially movable into and out of engagement with the converter bottom. Bracing devices are provided to support the ends of the clamping levers facing the converter jacket with respect to the converter jacket or the supporting construction.

14 Claims, 6 Drawing Figures

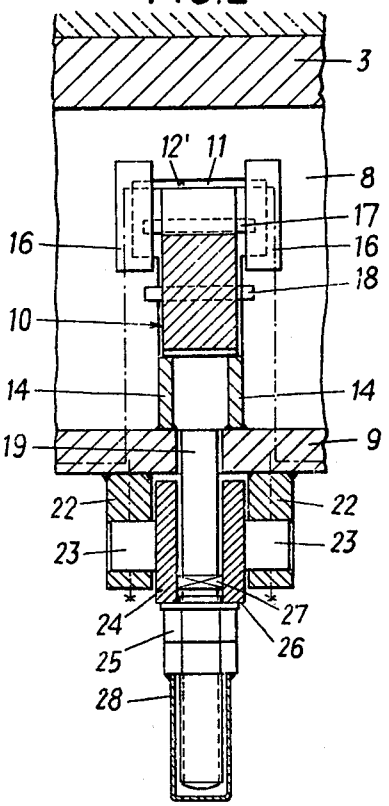
FIG. 2
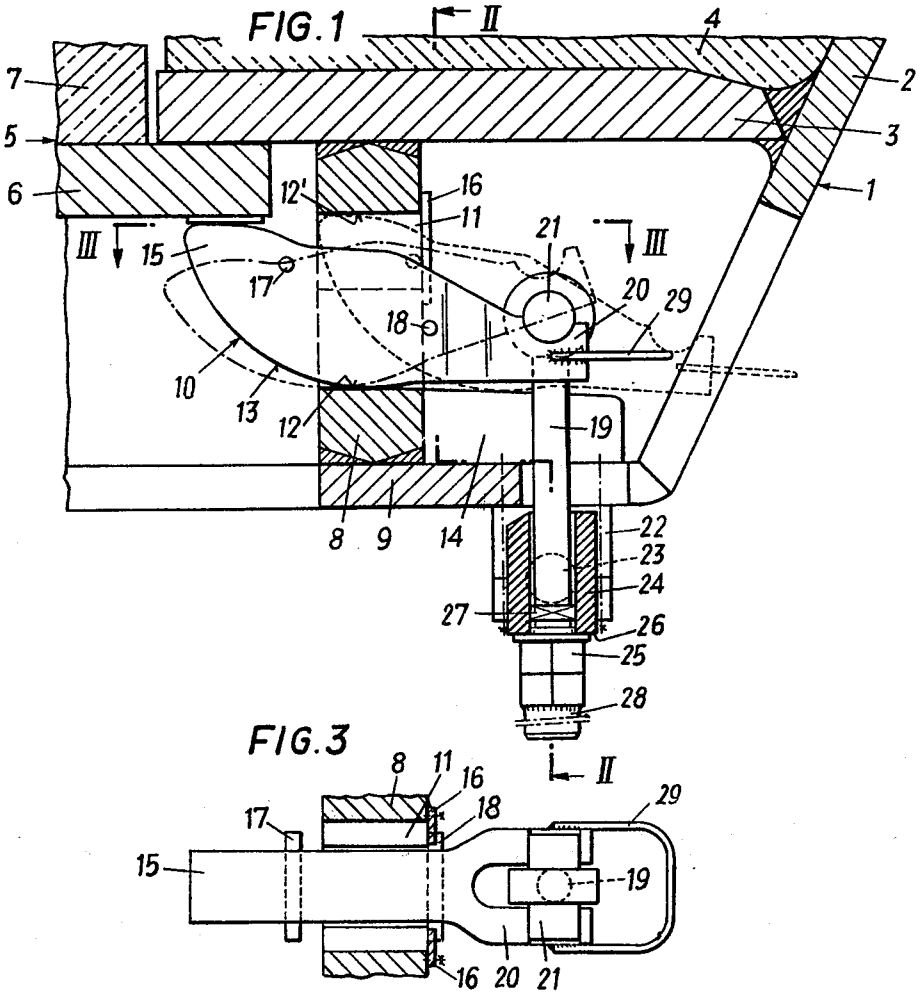
FIG. 1
FIG. 3

CONVERTER-BOTTOM-FASTENING MECHANISM

BACKGROUND OF THE INVENTION

The invention relates to a converter having a removable bottom which is, by means of a number of peripherally arranged clamping levers designed like rockers, to the converter jacket or to a supporting construction connected to the converter jacket. The clamping levers are displaceable out of and into the engagement position with the bottom.

A converter of this kind has been known e.g. from German Auslegeschrift No. 1,261,144, wherein the rocker-like clamping levers are braceable against a removable bottom by wedges. These wedges must be actuated in the radial direction perpendicular to the converter axis and, therefore at both ends of each wedge ample free space must be present for pushing it in and out. In bottom-blowing converters, this proves to be a disadvantage, because the great amount of space needed by the pipework of the bottom nozzles reduces the space around the securing elements and the accessability of the wedges is adversely affected. When the wedge connection is released or made, the pipework may become damaged. Furthermore, operating personnel are subjected to great physical demands because of the poor accessibility, and there is a danger that the fastening elements will not be attached tightly enough. This may lead to a loosening of the fastening elements whereby with bottom-blowing converters, inflammable gases may emerge and the safety of the plant may be reduced.

A further disadvantage of known bottom fastenings is that since the wedge angle is limited by the frictional conditions and the wedge length is limited because of the spacial conditions, differences in shape between the bottom edge and the edge of the converter jacket may only occur to a slight degree, otherwise the clamping levers cannot be applied to the bottom at all or can only be applied by using further aids, such as presses etc.

SUMMARY OF THE INVENTION

The invention aims at avoiding the above-described disadvantages and difficulties and has as its object to provide a converter of the above-defined kind, whose bottom can be attached by bracing means requiring only little free space. Furthermore, the bottom is to be braceable, in an easy manner and without additional aids, relative to the converter jacket in spite of pronounced differences in shape between the bottom edge and the edge of the converter jacket.

According to the invention, these objects are achieved in that the ends of the clamping levers facing the converter jacket are supported relative to the converter jacket or to the supporting construction by bracing means, in particular bracing screws.

A preferred embodiment is characterized in that a bracing screw is articulately connected with the clamping lever and with the converter jacket or the supporting construction.

It is advantageous if the end of the clamping lever facing the converter jacket is designed as a forked head in which a transverse bolt secured to the bracing screw is mounted.

According to a preferred embodiment, the bracing screw is inserted in a sleeve that is pivotably mounted on the converter jacket or on the supporting construction, which bracing screw is supported against the edge of the sleeve by a tension nut.

In order to prevent bracing screw rotating relative to the sleeve, the sleeve has a quadrangular interior cross section, and the bracing screw is provided with a projection having a corresponding quadrangular cross-section for the part that is inserted in the sleeve.

Suitably, a tension screw is provided as a bracing screw.

In order for the converter to be pivotable when the bottom is removed, without the clamping levers changing their positions and thus impeding the re-installation of the bottom, the supporting construction is provided with a face opposite the rocker face of the clamping lever. The end of the clamping lever facing the bottom is braceable against this opposite face of the supporting construction when the bottom is removed.

According to a further embodiment, a pressure screw penetrating the clamping lever is provided as bracing means.

A further embodiment is characterized in that as bracing means a pressure screw penetrating the supporting construction of the converter jacket and supported against the clamping lever is provided.

For easy handling of the clamping levers, the clamping levers are displaceable by means of adjustment levers arranged at those of their ends which face the converter jacket, the adjustment levers each being hinged with one end to the converter jacket or to the supporting construction, and being connected with the clamping lever via a bolt engaged in a recess provided in the adjustment lever.

For safe and simple operation with a converter in which a clamping lever having a side designed as a rocker face is mounted in a recess of the supporting construction secured to the converter jacket, bolts are arranged on the clamping lever for delimiting its displacement path, which bolts can be brought to a stop with the supporting construction.

BRIEF DESCRIPTION OF THE DRAWINGS

The invention shall now be described by way of example only and with reference to the accompanying drawings, wherein:

FIG. 1 is a vertical section of the lower part of a converter in the region of its bottom edge or jacket edge;

FIG. 2 is an illustration of a section along line II—II of FIG. 1;

FIG. 3 shows a section along line III—III of FIG. 1;

DESCRIPTION OF EXEMPLARY EMBODIMENTS

Figure 6:
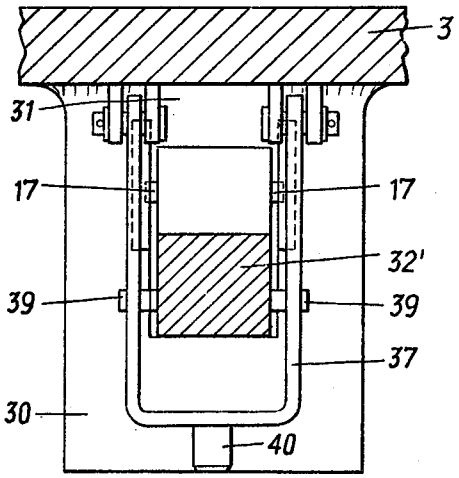
FIG. 6 shows a section along line VI—VI of FIG. 5.

On a plate jacket 2 of a converter 1, a supporting ring 3 is provided, which ring serves for accomodating the refractory brickwork 4. On this supporting ring, a removable bottom 5 is detachably fastened, which bottom includes bottom plate 6 and a refractory brickwork 7. A stiffening ring 8 abutting the supporting ring at a right angle and welded together therewith is reinforced at its lower side by a further supporting ring 9 arranged parallel to the supporting ring 3. The supporting rings (3, 9) and the stiffening ring 8 form a supporting construction reinforcing the lower edge of the converter jacket.

As fastening means for the bottom 5 there are provided a number of rocker-like clamping levers 10 distributed over the periphery of the bottom. The number of clamping levers depends on the size of the converter. Each clamping lever 10 is inserted in a recess 11 of the stiffening ring 8. The lower face 12 of the recess 11, which face is contacted by the side of the clamping lever 10 that is designed as rocker face 13, has two web plates 14 extending along it so that the clamping lever with its end 15 facing the bottom can be displaced out of an engagement position with the bottom into a position in which the end 15 of the clamping lever is outside of the space below the bottom plate 6. The displacement path of the clamping lever is delimited in both directions by two bolts (17, 18) which can be brought to a stop with the stiffening ring 8 and with plates 16 mounted thereon. The end of the clamping lever facing the converter jacket is hinged to a bracing screw designed as tension screw 19, and the tension screw in turn is articulately connected to the supporting ring 9. The joint connecting the tension screw 19 with the clamping lever 10 is formed by a fork shaped head end 20 of the clamping lever. In half-cylindrical-shaped recesses of the head end a transverse bolt 21 (FIG. 3) is accommodated, which transverse bolt is mounted on the tension screw. The joint connecting the tension screw 19 with the supporting ring 9 is formed by a sleeve 24, which sleeve is articulately mounted on brackets 22 of the supporting ring by means of axle stubs 23 (FIG. 2), and the sleeve 24 is penetrated by the tension screw. The tension screw is supported against the lower edge 26 of the sleeve by means of a tension nut 25. In order to guard the tension screw against rotation relative to the sleeve, the interior cross-section of the sleeve 24 is quadrangularly designed and on the part of the tension screw 19 extending through the sleeve a corresponding quadrangular projection 27 is provided. The lower end of the tension screw is guarded against dirt by a bushing 28 which can be screwed on to it.

For detaching the bottom 5, the tension nut 25 of the tension screw 19 is loosened at each clamping lever to such an extent that the clamping lever 10 can be drawn outward with a strap 29 mounted on its fork shaped head 20. If difficulties occur in detaching the tension nut, e.g. because of thermal stresses, warpings etc., the tension nuts can be cut off by a torch-cutting device. The clamping lever is drawn outwardly until the bolt 17 touches the plates 16. Thereupon the tension nut 25 can be tightened again, so that the clamping lever 10 is braced relative to a face 12' of the recess 11, which face 12' is arranged opposite the rocker face 13 and the face 12 of the clamping lever. The clamping lever 10 is thereby fixed in its position when the bottom has been removed. This position is entered in FIG. 1 in broken lines.

For securing a new or a newly lined bottom to the converter jacket, the tension nut 25 on each draw-in screw is loosened, whereby the end 15 of the clamping lever 10 facing the bottom descends. Thereupon the clamping lever 10 is displaced in the direction towards the bottom. This position is entered in FIG. 1 in dot-and-dash lines. It can be seen that because of the lowered end of the clamping lever, this end can be pushed underneath the bottom even if the shape of the bottom differs greatly from the supporting ring. The distance from below the bottom plate 6 which the end 15 of the clamping lever 10 can assume is delimited by the length of the tension screw. The bottom, which is located on the converter jacket prior to displacing the clamping lever towards the bottom, is subsequently pressed against the supporting ring 3 by tensioning the tension nuts 25.

Figure 4:
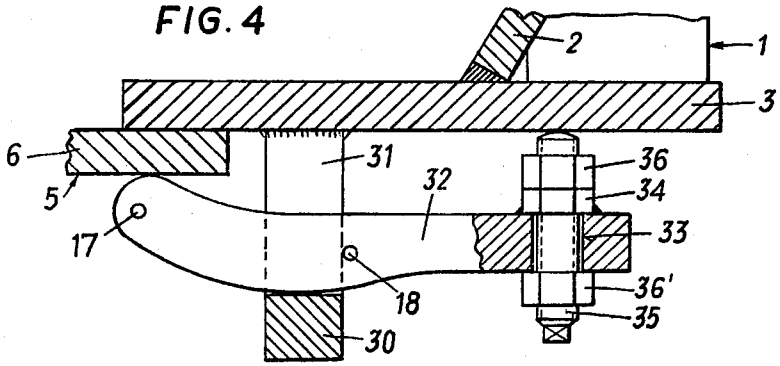
FIGS. 4 and 5 show further embodiments of the invention in a manner analogous to FIG. 1.

The embodiment illustrated in FIG. 4 is provided with a U-shaped strap 30, in whose recess 31 a rocker-shaped clamping lever 32 is inserted. At the end of the lever facing the outer side of the converter jacket the clamping lever is provided with a bore 33. At the end of the bore facing the supporting ring 3 a nut 34 is welded to the clamping lever. The clamping lever can be pressed against the bottom plate 6 by means of a pressure screw 35 inserted in the nut and penetrating the bore, which pressure screw is counter-supported on the supporting ring 3. For securing the pressure screw against rotation, safety nuts (36, 36') are provided.

Figure 5:
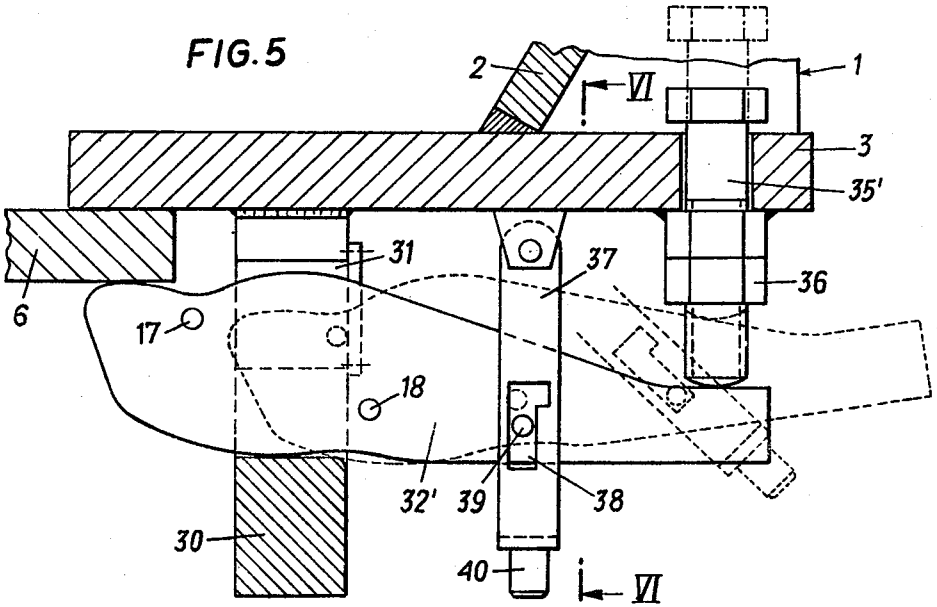

The embodiment illustrated in FIGS. 5 and 6 differs from that shown in FIG. 4 by the use of a pressure screw 35' penetrating the supporting ring 3 and counter-supported on the clamping lever 32'. An adjustment lever 37 which is U-shaped and encompasses the clamping lever 32' at that end of the clamping lever which faces the converter jacket, serves as a simple means for displacement of the clamping lever. The adjustment lever 37 is hinged to the supporting ring 3 and is provided with L-shaped recesses 38 on its strap parts lateral of the clamping lever. Bolts 39 protruding laterally from the clamping lever engage in these L-shaped recesses. To a pin 40 arranged at the lower, horizontal strap portion of the adjustment lever, a slip-on pipe (not illustrated) can be attached for pivoting the adjustment lever 37, thus displacing the clamping lever 32'. In FIG. 5 the clamping position is indicated in full lines and the position of the adjustment lever in which the bottom plate 6 can be taken off is indicated in broken lines.

The invention is not to be restricted to the embodiments illustrated but may be modified in various ways. Thus it is also possible to use turnbuckles or knee lever presses instead of the bracing screws.

What we claim is:

1. In a converter-bottom-fastening mechanism to be used in a converter construction having a removable converter bottom, a converter jacket defining a bottom opening to be covered by the removable converter bottom, and a supporting construction connected to said converter jacket, said mechanism including a plurality of rocker-shaped clamping levers with rocker faces, said clamping levers being peripherally arranged about the removable converter bottom and captured on the converter construction, the improvement comprising:

rocker-like clamping levers that are axially displaceable into and out of an engagement position with said converter bottom in which one of the ends of each of the clamping levers braces the bottom upwardly into the bottom opening;

bracing means located between said clamping levers and said converter construction for articulately supporting the other ends of the clamping levers, which other ends face the converter jacket, with respect to the converter construction, and support members for supporting the center of the clamping levers so that the bracing means can pivot the clamping levers, when in the engagement position, upward against the converter bottom so as to fasten it within the opening in the converter jacket.

2. A converter-bottom-fastening mechanism as set forth in claim 1, wherein said clamping levers are captured on the converter jacket and wherein the bracing means support other ends of the clamping levers facing the converter jacket with respect to the converter jacket.

3. A converter-bottom-fastening mechanism as set forth in claim 1, wherein said clamping levers are captured on the supporting construction connected to the converter jacket and wherein the bracing means support other ends of the clamping levers facing the converter jacket with respect to said supporting construction connected to the converter jacket.

4. A converter-bottom-fastening mechanism as set forth in claim 1, wherein said bracing means include bracing screws.

5. A converter-bottom-fastening mechanism as set forth in claim 4, further comprising first means for articulately connecting each bracing screw with the clamping lever and second means for articulately connecting each bracing screw with the converter construction.

6. A converter-bottom-fastening mechanism as set forth in claim 5, wherein the other end of the clamping lever facing the converter jacket is designed as a fork-shaped head and wherein said first means for articulately connecting each bracing screw with the clamping lever include a transverse bolt secured to the bracing screw, said transverse bolt being mounted in said fork shaped head.

7. A converter-bottom-fastening mechanism as set forth in claim 5, wherein said second means for articulately connecting each bracing screw with the converter construction include a sleeve pivotably mounted on the converter construction, said bracing screw being inserted in said sleeve, and wherein said bracing means further include a tension nut supporting said bracing screw against the lower edge of the sleeve.

8. A converter-bottom-fastening mechanism as set forth in claim 7, wherein said sleeve has a quadrangular interior cross-section and the bracing screw is provided with a projection where it is inserted in the sleeve, said projection having a quadrangular cross-section corresponding to the quadrangular cross-section of the sleeve.

9. A converter-bottom-fastening mechanism as set forth in claim 5, wherein each bracing screw is a tension screw.

10. A converter-bottom-fastening mechanism as set forth in claim 1, wherein said supporting construction has a face arranged opposite the rocker face of each clamping lever, and wherein said end of each clamping lever for bracing the removable converter bottom is also braceable relative to said face of the supporting construction arranged opposite the rocker face of each clamping lever, while said removable converter bottom is removed.

11. A converter-bottom-fastening mechanism as set forth in claim 1, wherein each bracing means includes a pressure screw penetrating the clamping lever.

12. A converter-bottom-fastening mechanism as set forth in claim 1, wherein each bracing means includes a presssure screw penetrating the supporting construction connected to the converter jacket, which pressure screw is supported against the clamping lever.

13. A converter-bottom-fastening mechanism as set forth in claim 1, further comprising an adjustment lever having a recess, said adjustment lever being provided at said other end of the clamping lever facing the converter jacket for displacement of said clamping lever, a bolt being provided on each clamping lever, the bolt engaging in the recess of the adjustment lever thus connecting the clamping lever with its respective adjustment lever, which adjustment lever at one end thereof is articulately connected with the converter construction.

14. A converter-bottom-fastening mechanism as set forth in claim 1, wherein said support members are part of the supporting construction connected to the converter jacket and are each provided with a recess for accommodating the clamping lever, including rocker face of the respective clamping lever, and further comprising bolts arranged on each clamping lever, the bolts being capable of being brought to a stop with the supporting construction to delimit the axial displacement of the clamping lever.

* * * * *

UNITED STATES PATENT OFFICE

CERTIFICATE OF CORRECTION

Patent No. 4,128,233 Dated Dec. 5, 1978

Inventor(s) Eysn et al.

It is certified that error appears in the above-identified patent and that said Letters Patent are hereby corrected as shown below:

Col. 1, line 7, after "is" insert --secured--;

Col. 2, line 3, after "prevent" insert --the--;

Col. 3, line 66, delete "from";

Col. 5, line 4, after "support" insert --the--; and

Col. 5, line 11, before "other" insert --the--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*